US008978603B2

(12) United States Patent
Williams et al.

(10) Patent No.: US 8,978,603 B2
(45) Date of Patent: Mar. 17, 2015

(54) SIX-STROKE INTERNAL COMBUSTION ENGINE VALVE ACTIVATION SYSTEM AND METHOD FOR OPERATING SUCH ENGINE

(71) Applicant: Caterpillar Inc., Peoria, IL (US)

(72) Inventors: D. Ryan Williams, Edwards, IL (US); Scott B. Fiveland, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 9 days.

(21) Appl. No.: 13/712,285

(22) Filed: Dec. 12, 2012

(65) Prior Publication Data

US 2014/0158072 A1 Jun. 12, 2014

(51) Int. Cl.
*F02B 75/02* (2006.01)

(52) U.S. Cl.
CPC ..... *F02B 75/021* (2013.01)
USPC ..... 123/64; 123/52.1

(58) Field of Classification Search
CPC ..... F02B 75/021; F02B 75/18; Y02T 10/18; Y02T 10/146; F01L 2800/00; F01L 2800/10; F02D 2041/001; F02D 13/0242; F02D 41/0065; F02N 19/004; F02M 25/0752; F02M 25/0748; F02M 25/0749
USPC ..... 123/64, 52.1
See application file for complete search history.

(56) References Cited

U.S. PATENT DOCUMENTS 2,249,997 A * 7/1941 Wydler ..... 123/1 R
4,179,892 A 12/1979 Heydrich
4,736,715 A 4/1988 Larsen
5,224,460 A 7/1993 Havstad et al.
5,284,116 A 2/1994 Richeson, Jr.
5,433,180 A * 7/1995 Hitomi et al. ..... 123/311
5,564,275 A 10/1996 Codan et al.
6,209,324 B1 4/2001 Daudel et al.
6,293,092 B1 9/2001 Ament et al.
6,295,817 B1 10/2001 Abthoff et al.
6,311,651 B1 * 11/2001 Singh ..... 123/25 C
6,321,731 B1 11/2001 Russ et al.
6,324,847 B1 12/2001 Pierpont
6,332,446 B1 12/2001 Matsumoto et al.
6,491,016 B1 12/2002 Buratti
6,557,779 B2 5/2003 Perr et al.
6,564,758 B1 5/2003 Enderle et al.
6,619,241 B2 9/2003 Otterspeer et al.
6,622,693 B2 9/2003 Arndt et al.
6,705,543 B2 3/2004 Carroll, III et al.

(Continued)

FOREIGN PATENT DOCUMENTS

JP 03-115743 5/1991
WO WO 2009/081227 A1 7/2009
WO WO 2010/075165 A1 7/2010

*Primary Examiner* — Noah Kamen
*Assistant Examiner* — Long T Tran
(74) *Attorney, Agent, or Firm* — Leydig, Voit & Mayer, Ltd.

(57) ABSTRACT

An engine combustion cylinder is fluidly connectable to an intake system through an intake valve and to an exhaust system through an exhaust valve. A valve activation system is to activate the intake valve and the exhaust valve. The valve activation system is responsive to a controller providing command signals to the valve activation system such that, when the engine operates in a six-stroke combustion cycle, the intake valve is opened during a recompression stroke to allow a portion of the products from the first combustion stroke to exit the combustion cylinder and enter into the intake system.

23 Claims, 6 Drawing Sheets

(56) References Cited

U.S. PATENT DOCUMENTS

| | | | | |
|---|---|---|---|---|
| 6,758,174 | B1 | 7/2004 | Fuerhapter | |
| 6,772,742 | B2 | 8/2004 | Lei et al. | |
| 6,807,956 | B2 | 10/2004 | Gaessler et al. | |
| 6,941,746 | B2 | 9/2005 | Tarabulski et al. | |
| 6,966,505 | B2 | 11/2005 | Peterson, Jr. | |
| 7,031,821 | B2 | 4/2006 | Lewis et al. | |
| 7,096,848 | B2 | 8/2006 | Ono et al. | |
| 7,143,725 | B1 | 12/2006 | Hu | |
| 7,181,902 | B2 | 2/2007 | Naik | |
| 7,213,565 | B2 | 5/2007 | Grünaug et al. | |
| 7,264,785 | B2 | 9/2007 | Blakeman et al. | |
| 7,287,378 | B2 | 10/2007 | Chen et al. | |
| 7,418,928 | B2 | 9/2008 | Fiveland | |
| 7,422,000 | B2 | 9/2008 | Kesse et al. | |
| 7,426,916 | B2 | 9/2008 | Reed et al. | |
| 7,500,475 | B2 | 3/2009 | Raymond et al. | |
| 7,513,239 | B2 | 4/2009 | Blessing et al. | |
| 7,556,017 | B2 | 7/2009 | Gibson | |
| 7,574,983 | B2 * | 8/2009 | Kuo | 123/25 C |
| 7,597,865 | B2 | 10/2009 | Mori et al. | |
| 7,673,590 | B2 | 3/2010 | Reed et al. | |
| 7,685,990 | B2 | 3/2010 | Dingle | |
| 7,726,268 | B2 | 6/2010 | Kelem et al. | |
| 7,763,222 | B2 | 7/2010 | Miyairi et al. | |
| 7,832,370 | B2 * | 11/2010 | Sutherland et al. | 123/143 A |
| 7,867,598 | B2 | 1/2011 | Miyairi et al. | |
| 7,891,345 | B2 | 2/2011 | Pierpont | |
| 8,051,659 | B2 | 11/2011 | Yamashita et al. | |
| 8,096,279 | B2 | 1/2012 | Kuzuyama | |
| 8,136,504 | B2 | 3/2012 | Winstead | |
| 8,141,352 | B2 | 3/2012 | Tsujimoto et al. | |
| 8,215,292 | B2 * | 7/2012 | Bryant | 123/559.1 |
| 8,291,872 | B2 * | 10/2012 | Szybist et al. | 123/64 |
| 2008/0047509 | A1 * | 2/2008 | Sellnau et al. | 123/90.15 |
| 2008/0283006 | A1 * | 11/2008 | Sutherland et al. | 123/90.15 |
| 2009/0145382 | A1 | 6/2009 | Kawai | |
| 2009/0272363 | A1 * | 11/2009 | Yun et al. | 123/295 |
| 2010/0050963 | A1 | 3/2010 | Ooyama | |
| 2010/0064994 | A1 * | 3/2010 | Colliou et al. | 123/90.16 |
| 2010/0083921 | A1 * | 4/2010 | Ooyama | 123/64 |
| 2010/0212300 | A1 | 8/2010 | Fiveland et al. | |
| 2010/0269775 | A1 | 10/2010 | Chandes et al. | |
| 2010/0299049 | A1 * | 11/2010 | Kang et al. | 701/103 |
| 2011/0017170 | A1 * | 1/2011 | Song et al. | 123/25 C |
| 2011/0162349 | A1 | 7/2011 | Cheng et al. | |
| 2011/0197852 | A1 | 8/2011 | Meyman | |
| 2012/0023935 | A1 * | 2/2012 | Pursifull et al. | 60/605.2 |
| 2012/0166066 | A1 * | 6/2012 | Fiveland et al. | 701/104 |

* cited by examiner 106
120
136
146
254
258
260
262
264
266
250
252
256

SIX-STROKE INTERNAL COMBUSTION ENGINE VALVE ACTIVATION SYSTEM AND METHOD FOR OPERATING SUCH ENGINE

TECHNICAL FIELD

This patent disclosure relates generally to internal combustion engines and, more particularly, to internal combustion engines configured to operate on a six-stroke internal combustion cycle.

BACKGROUND

Internal combustion engines operating on a six-stroke cycle are generally known in the art. In a six-stroke cycle, a piston reciprocally disposed in a cylinder moves through an intake stroke from a top dead center (TDC) position towards a bottom dead center (BDC) position to admit air or a mixture of air with fuel and/or exhaust gas into the cylinder through one or more intake valves. The intake valve(s) selectively fluidly connect the cylinder with an air source, and are in an open position during the intake stroke to allow the cylinder to fill with air or a mixture thereof.

When the cylinder has sufficiently filled, the intake valve (s) close(s) to fluidly trap the air or air mixture within the cylinder. During a compression stroke, the piston moves back towards the TDC position to compress the air or the air mixture trapped in the cylinder. During this process, an initial or additional fuel charge may be introduced to the cylinder by an injector. The compressed air/fuel mixture in the cylinder then ignites, thus increasing fluid pressure within the cylinder. The increased pressure pushes the piston towards the BDC position in what is commonly referred to as a combustion or power stroke.

In accordance with the six-stroke cycle, the piston performs a second compression stroke in which it recompresses the combustion products remaining in the cylinder after the first combustion or power stroke. During this recompression, any exhaust valves associated with the cylinder remain generally closed to assist cylinder recompression. Optionally, a second fuel charge and/or additional air may be introduced into the cylinder during recompression to assist igniting the residual combustion products and produce a second power stroke. Following the second power stroke, the cylinder undergoes an exhaust stroke during which the piston moves towards the TDC position and one or more exhaust valves are opened to help evacuate combustion by-products from the cylinder.

One example of an internal combustion engine configured to operate on a six-stroke engine can be found in U.S. Pat. No. 7,418,928. This disclosure relates to a method of operating an engine that includes compressing part of the combustion gas after a first combustion stroke of the piston as well as an additional combustion stroke during a six-stroke cycle of the engine.

The re-compression and re-combustion of combustion products from the first power stroke of a cylinder in six-stroke engines, however, often results in increased emissions, and especially emissions that result when the fluids within the cylinder are at a high temperature. For example, the production of nitrous oxides (NOx) increases with increasing cylinder temperatures. The production of such and other emissions is disfavored, especially since NOx emissions are regulated for diesel engines.

SUMMARY

In one aspect, the disclosure describes an internal combustion engine having a combustion cylinder. The combustion cylinder operates on a combustion cycle that includes an intake stroke, during which air is admitted into the combustion cylinder, a compression stroke, during which the air in the combustion cylinder is compressed and fuel is added, a first combustion stroke, a recompression stroke, during which products from the first combustion stroke are compressed in the combustion cylinder and additional fuel is added, a second combustion stroke, and an exhaust stroke. The engine further includes an intake system including an intake collector in fluid communication with the combustion cylinder, and an exhaust system including an exhaust collector in fluid communication with the combustion cylinder. At least one intake valve is disposed to selectively fluidly connect the combustion cylinder with the intake system, and at least one exhaust valve is disposed to selectively fluidly connect the combustion cylinder with the exhaust system. A valve activation system is configured to activate the at least one intake valve and the at least one exhaust valve. A controller associated with the internal combustion engine is configured to provide command signals to the valve activation system such that the at least one intake valve is opened during the recompression stroke to allow a portion of the products from the first combustion stroke to exit the combustion cylinder and enter into the intake collector.

In another aspect, the disclosure describes an additional embodiment of an internal combustion engine having a combustion cylinder. The combustion cylinder operates on a combustion cycle that includes an intake stroke, during which air is admitted into the combustion cylinder, a compression stroke, during which the air in the combustion cylinder is compressed and fuel is added, a first combustion stroke, a recompression stroke, during which products from the first combustion stroke are compressed in the combustion cylinder and additional fuel is added, a second combustion stroke, and an exhaust stroke. The engine includes an intake system including an intake collector in fluid communication with the combustion cylinder, an exhaust system configured to receive exhaust gas from the combustion cylinder. The exhaust system includes an exhaust collector in fluid communication with the combustion cylinder. The engine further includes a blowdown gas passage in fluid communication with the combustion cylinder and the intake system, where the blowdown gas passage is fluidly isolated from the exhaust system. At least one intake valve is disposed to selectively fluidly connect the combustion cylinder with the intake system, and at least one exhaust valve is disposed to selectively fluidly connect the combustion cylinder with the exhaust system. At least one recirculation valve is disposed to selectively fluidly connect the combustion cylinder with the blowdown gas passage. A valve activation system is configured to activate the at least one intake valve, the at least one recirculation valve, and the at least one exhaust valve. A controller associated with the internal combustion engine is configured to provide command signals to the valve activation system such that the at least one recirculation valve is opened during the recompression stroke to allow a portion of the products from the first combustion stroke to exit the combustion cylinder and enter into the intake collector through the blowdown gas passage.

In yet another aspect, the disclosure describes a method for operating a valve system on an internal combustion engine having a combustion cylinder, which operates on a combustion cycle that includes an intake stroke, during which air is admitted into the combustion cylinder, a compression stroke, during which the air in the combustion cylinder is compressed and fuel is added, a first combustion stroke, a recompression stroke, during which products from the first combustion stroke are compressed in the combustion cylinder and additional fuel is added, a second combustion stroke, and an exhaust stroke. The method includes fluidly connecting the combustion cylinder with an intake system to provide an air mixture to fill the combustion cylinder during the intake stroke. The method further includes fluidly connecting the combustion cylinder with the intake system to introduce products from the first combustion stroke into the intake system during the recompression stroke, and mixing the products from the first combustion stroke with air in the intake system to form the air mixture. The method also includes fluidly connecting the combustion cylinder with an exhaust system during the exhaust stroke to evacuate products of the second combustion from the combustion cylinder.

DETAILED DESCRIPTION

This disclosure generally relates to internal combustion engines and, more particularly, to engines operating with a six stroke cycle. More specifically, certain disclosed engine embodiments are configured to optimize engine operation and reduce emissions by employing two paths for exhaust gas recirculation. In general, internal combustion engines burn a hydrocarbon-based fuel or another combustible fuel source to convert the potential or chemical energy therein to mechanical power that can be utilized for other work. In one embodiment, the disclosed engine may be a compression ignition engine, such as a diesel engine, in which a mixture of air and fuel are compressed in a cylinder to raise their pressure and temperature to a point of at which auto-ignition or spontaneous ignition occurs. Such engines typically lack a sparkplug that is typically associated with gasoline burning engines. However, in alternative embodiments, the utilization of different fuels such as gasoline and different ignition methods, for example, use of diesel as a pilot fuel to ignite gasoline or natural gas, are contemplated and fall within the scope of the disclosure.

Figure 1:
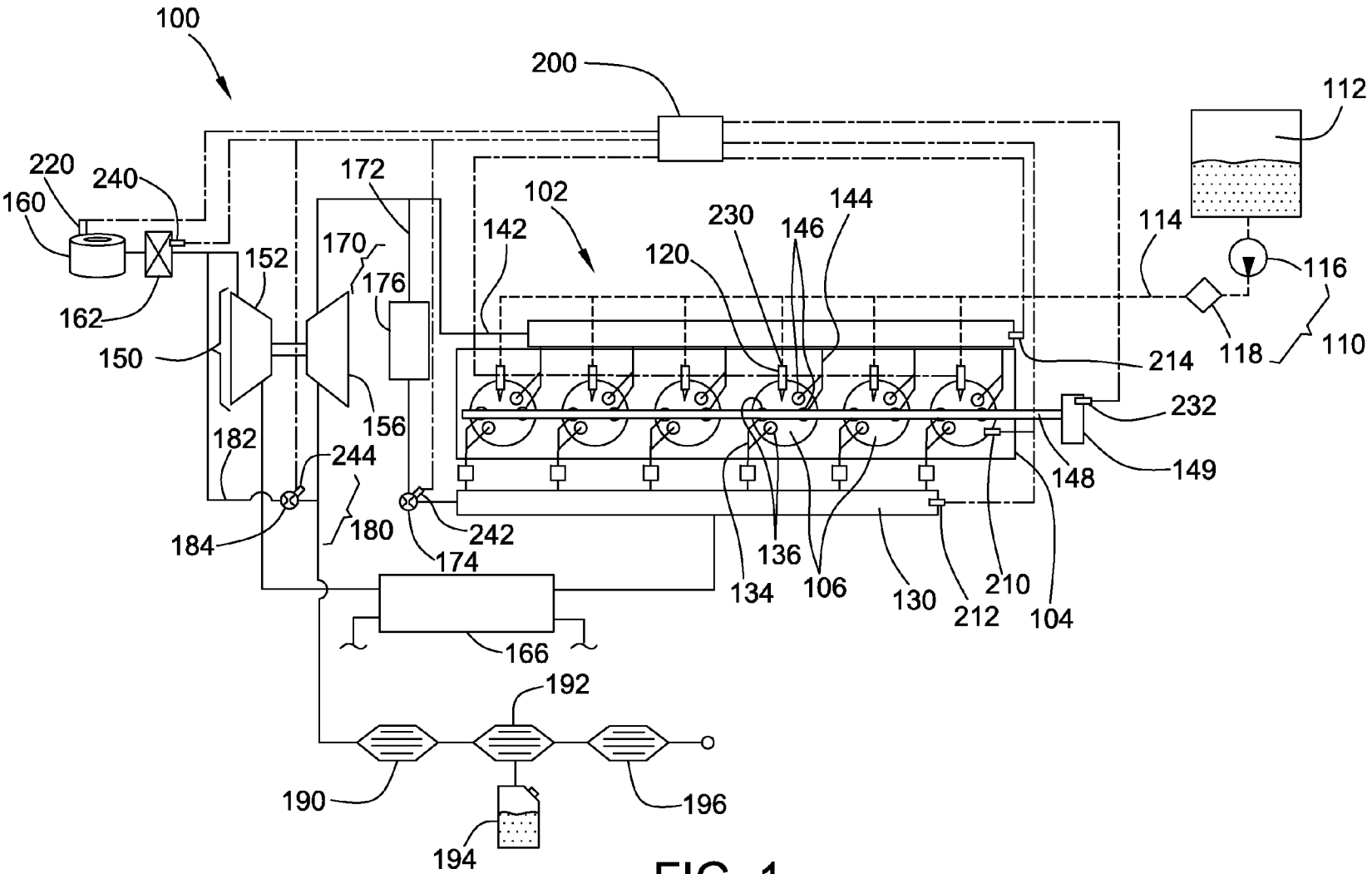
FIG. 1 is a block diagram of an engine system having an internal combustion engine adapted for operation in accordance with a six-stroke combustion cycle and associated systems and components for performing the combustion process.

Now referring to FIG. 1, wherein like reference numbers refer to like elements, there is illustrated a block diagram representing an internal combustion engine system 100. The engine system 100 includes an internal combustion engine 102 and, in particular, a diesel engine that combusts a mixture of air and diesel fuel. The illustrated internal combustion engine 102 includes an engine block 104 in which a plurality of combustion chambers 106 are disposed. Although six combustion chambers 106 are shown in an inline configuration, in other embodiments fewer or more combustion chambers may be included or another configuration such as a V-configuration may be employed. The engine system 100 can be utilized in any suitable application including mobile applications such as motor vehicles, work machines, locomotives or marine engines, and stationary applications such as electrical power generators, pumps and others.

To supply the fuel that the engine 102 burns during the combustion process, a fuel system 110 is operatively associated with the engine system 100. The fuel system 110 includes a fuel reservoir 112 that can accommodate a hydrocarbon-based fuel such as liquid diesel fuel. Although only one fuel reservoir is depicted in the illustrated embodiment, it will be appreciated that in other embodiments additional reservoirs may be included that accommodate the same or different types of fuels that may also be burned during the combustion process. In the illustrated embodiment, a fuel line 114 directs fuel from the fuel reservoir 112 to the engine. To pressurize the fuel and force it through the fuel line 114, a fuel pump 116 can be disposed in the fuel line. An optional fuel conditioner 118 may also be disposed in the fuel line 114 to filter the fuel or otherwise condition the fuel by, for example, introducing additives to the fuel, heating the fuel, removing water and the like.

To introduce the fuel to the combustion chambers 106, the fuel line 114 may be in fluid communication with one or more fuel injectors 120 that are associated with the combustion chambers. In the illustrated embodiment, one fuel injector 120 is associated with each combustion chamber but in other embodiments different numbers of injectors might be included. Additionally, while the illustrated embodiment depicts the fuel line 114 terminating at the fuel injectors, the fuel line may establish a fuel loop that continuously circulates fuel through the plurality of injectors and, optionally, delivers unused fuel back to the fuel reservoir 112. Alternatively, or in addition, the fuel line 114 may include a high-pressure fuel collector (not shown), which supplies the fuel injectors with pressurized fuel during operation. The fuel injectors 120 can be electrically actuated devices that selectively introduce a measured or predetermined quantity of fuel to each combustion chamber 106. In other embodiments, introduction methods other than or in addition to fuel injectors, such as a carburetor or the like, can be utilized.

To supply the air to the combustion chambers 106, a hollow runner or intake manifold 130 can be formed in or attached to the engine block 104 such that it extends over or proximate to each of the combustion chambers. The intake manifold 130 can communicate with an intake line 132 that directs air to the internal combustion engine 102. Fluid communication between the intake manifold 130 and the combustion chambers 106 can be established by a plurality of intake runners 134 extending from the intake manifold. One or more intake valves 136 can be associated with each combustion chamber 106 and can open and close to selectively introduce the intake air from the intake manifold 130 to the combustion chamber. While the illustrated embodiment depicts the intake valves at the top of the combustion chamber 106, in other embodiments the intake valves may be placed at other locations such as through a sidewall of the combustion chamber. To direct the exhaust gasses produced by combustion of the air/fuel mixture out of the combustion chambers 106, an exhaust manifold 140 communicating with an exhaust line 142 can also be disposed in or proximate to the engine block 104. The exhaust manifold 140 can communicate with the combustion chambers 106 by exhaust runners 144 extending from the exhaust manifold 140. The exhaust manifold 140 can receive exhaust gasses by selective opening and closing of one or more exhaust valves 146 associated with each chamber.

To actuate the intake valves 136 and the exhaust valves 146, the illustrated embodiment depicts an overhead camshaft 148 that is disposed over the engine block 104 and operatively engages the valves, but other valve activation arrangements and structures can be used. As will be familiar to those of skill in the art, the camshaft 148 can include a plurality of eccentric lobes disposed along its length that, as the camshaft rotates, cause the intake and exhaust valves 136, 146 to displace or move up and down in an alternating manner with respect to the combustion chambers 106. The placement or configuration of the lobes along the camshaft 148 controls or determines the gas flow through the internal combustion engine 102. In an embodiment, the camshaft 148 can be configured to selectively control the relative timing and the duration of the valve opening and closing events through a process referred to as variable valve timing. Various arrangements for achieving variable valve timing are known. In one embodiment, contoured lobes formed on the camshaft 148 are manipulated to alter the timing and duration of valve events by moving the camshaft along its axis to expose the valve activators to changing lobe contours. To implement these adjustments in the illustrated embodiment, the camshaft 148 can be associated with a camshaft actuator 149. As is known in the art, other methods exist for implementing variable valve timing such as additional actuators acting on the individual valve stems and the like.

Figure 2:
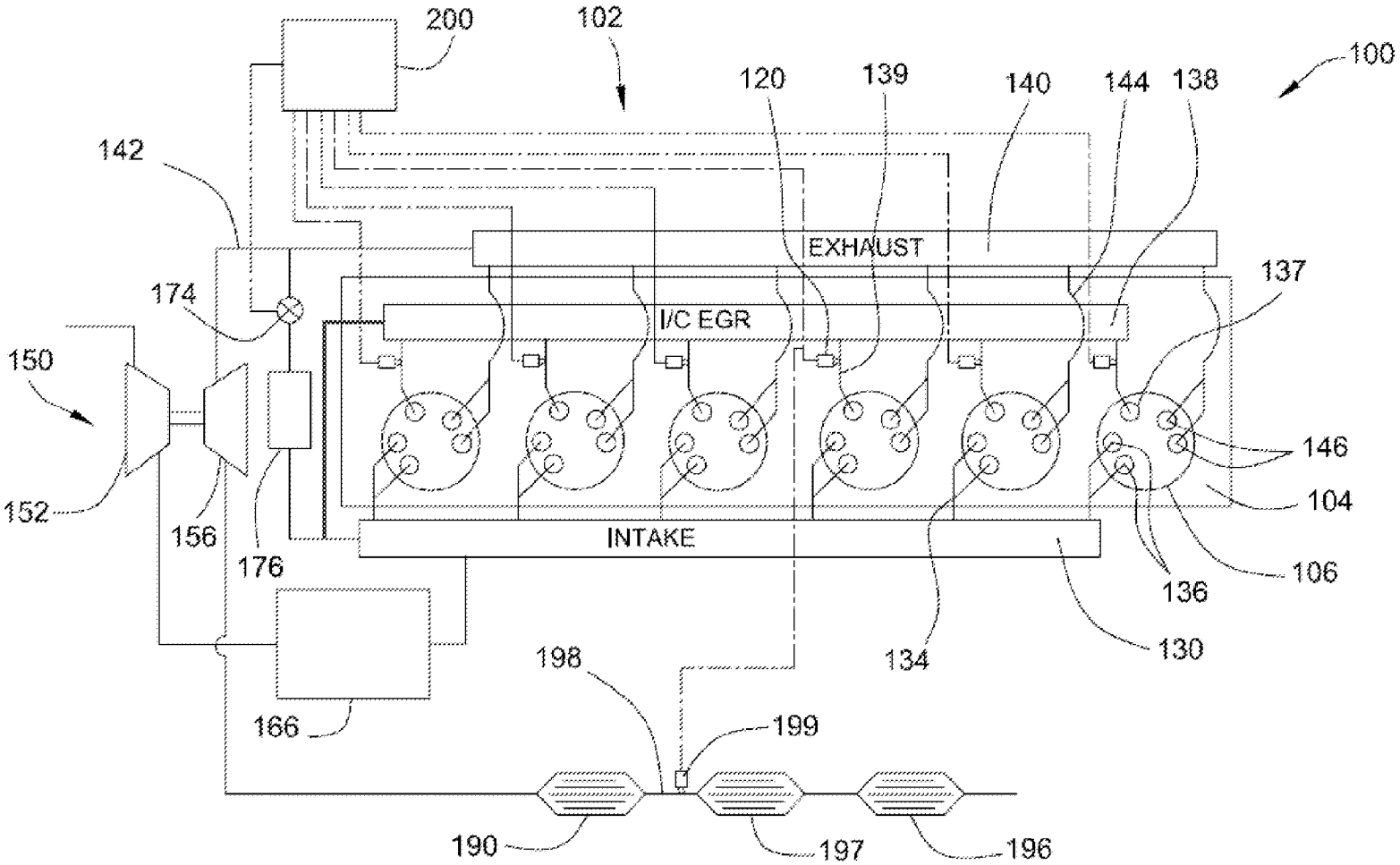
FIG. 2 is a block diagram for an alternative embodiment of an engine having additional valves communicating with the combustion chambers in accordance with the disclosure.

A block diagram for an alternative embodiment for an engine is shown in FIG. 2, where like numerals denote like structures described relative to FIG. 1. In this embodiment, each combustion chamber 106 includes a recirculation valve 137, which communicates with a blowdown gas passage or recirculation passage 138 via a recirculation runner 139. The recirculation passage 138 in the illustrated embodiment is fluidly connected to the engine intake air system supplying pressurized fluids to the intake manifold 130. The recirculation valves 137 can be activated by the same methods activating the intake and exhaust valves 136 and 146, for example, the camshaft 148 (shown in FIG. 1).

In reference now to the embodiments shown in both FIGS. 1 and 2, to assist in directing the intake air to and exhaust gasses from the internal combustion engine 102, the engine system 100 can include a turbocharger 150. The turbocharger 150 includes a compressor 152 disposed in the intake line 132 that compresses intake air drawn from the atmosphere and directs the compressed air to the intake manifold 130. Although a single turbocharger 150 is shown, more than one such device connected in series and/or in parallel with another can be used. To power the compressor 152, a turbine 156 can be disposed in the exhaust line 142 and can receive pressurized exhaust gasses from the exhaust manifold 140. The pressurized exhaust gasses directed through the turbine 156 can rotate a turbine wheel having a series of blades thereon, which powers a shaft that causes a compressor wheel to rotate within the compressor housing.

To filter debris from intake air drawn from the atmosphere, an air filter 160 can be disposed upstream of the compressor 152. In some embodiments, the engine system 100 may be open-throttled wherein the compressor 152 draws air directly from the atmosphere with no intervening controls or adjustability, while in other embodiments, to assist in controlling or governing the amount of air drawn into the engine system 100, an adjustable governor or intake throttle 162 can be disposed in the intake line 132 between the air filter 160 and the compressor 152. Because the intake air may become heated during compression, an intercooler 166 such as an air-to-air heat exchanger can be disposed in the intake line 132 between the compressor 152 and the intake manifold 130 to cool the compressed air.

To reduce emissions and assist adjusted control over the combustion process, the engine system 100 can mix the intake air with a portion of the exhaust gasses drawn from the exhaust system of the engine through a system or process called exhaust gas recirculation ("EGR"). The EGR system forms an intake air/exhaust gas mixture that is introduced to the combustion chambers. In one aspect, addition of exhaust gasses to the intake air displaces the relative amount of oxygen in the combustion chamber during combustion that results in a lower combustion temperature and reduces the generation of nitrogen oxides. Two exemplary EGR systems are shown associated with the engine system 100 in FIG. 1, but it should be appreciated that these illustrations are exemplary and that either one, both, or neither can be used on the engine. It is contemplated that selection of an EGR system of a particular type may depend on the particular requirements of each engine application.

In the first embodiment, a high-pressure EGR system 170 operates to direct high-pressure exhaust gasses to the intake manifold 130. The high-pressure EGR system 170 includes a high-pressure EGR line 172 that communicates with the exhaust line 142 downstream of the exhaust manifold 140 and upstream of the turbine 156 to receive the high-pressure exhaust gasses being expelled from the combustion chambers 106. The system is thus referred to as a high-pressure EGR system 170 because the exhaust gasses received have yet to depressurize through the turbine 156. The high-pressure EGR line 172 is also in fluid communication with the intake manifold 130. To control the amount or quantity of the exhaust gasses combined with the intake air, the high-pressure EGR system 170 can include an adjustable EGR valve 174 disposed along the high-pressure EGR line 172. Hence, the ratio of exhaust gasses mixed with intake air can be varied during operation by adjustment of the adjustable EGR valve 174. Because the exhaust gasses may be at a sufficiently high temperature that may affect the combustion process, the high-pressure EGR system can also include an EGR cooler 176 disposed along the high-pressure EGR line 172 to cool the exhaust gasses.

In the second embodiment, a low-pressure EGR system 180 directs low-pressure exhaust gasses to the intake line 132 before it reaches the intake manifold 130. The low-pressure EGR system 180 includes a low-pressure EGR line 182 that communicates with the exhaust line 142 downstream of the turbine 156 so that it receives low-pressure exhaust gasses that have depressurized through the turbine, and delivers the exhaust gas upstream of the compressor 152 so it can mix and be compressed with the incoming air. The system is thus referred to as a low-pressure EGR system because it operates using depressurized exhaust gasses. To control the quantity of exhaust gasses re-circulated, the low-pressure EGR line 182 can also include an adjustable EGR valve 184.

In both the high- and low-pressure EGR system embodiments, exhaust gas from the exhaust manifold is recirculated into the intake of the engine, as shown in FIGS. 1 and 2. As will be described in further detail below, exhaust gas from the exhaust manifold has already undergone the re-compression and re-combustion process that is employed in the six-stroke combustion cycle. However, exhaust gas removed from the engine cylinders between combustion events, i.e., after the first combustion event has transpired and before the second combustion occurs, can also be supplied to the engine cylinders. Accordingly, an additional path for recirculating exhaust gas that is well suited for a six-stroke engine is provided in the embodiment for the engine 100 shown in FIG. 2. Here, the recirculation passage 138 can be configured to receive exhaust gas from the combustion chambers 106 following a first combustion event and before a second combustion event occurs in each combustion chamber 106 in accordance with the six-stroke mode of engine operation. In this way, under conditions when the exhaust byproducts of the first combustion event are being recompressed and have a pressure that is at least the same as or greater than the intake manifold pressure, the recirculation valves 137 may be opened such that exhaust gas from within the respective combustion chambers 106 can flow out of each chamber 106, through the recirculation passage 139 and through the recirculation passage 138 directly into the intake manifold 130 of the engine.

When this more direct type of exhaust recirculation is employed, the low- and/or high-pressure EGR systems 180 and 170 of the engine 100 (see FIG. 1) can be bypassed or possibly eliminated. It should be appreciated, however, that the recirculation passage 138 may also serve as part of the intake system that can provide air from the intake system into the combustion chambers when the recirculation valves 137 are open and the fluid pressure in the engine intake system is higher than the pressure of fluids within the combustion chamber.

It should also be appreciated that the composition of the exhaust gas passing through the recirculation passage 138 may be different in some respects than the exhaust gas passing through the EGR system 170 or 180. Specifically, while the exhaust gas that passes through the EGR system 170 and 180 is provided from the exhaust manifold 140 after it has been exhausted from the engine cylinders following a first combustion, recompression, and second combustion strokes in accordance with a six-stroke cycle, exhaust gas provided through the recirculation passage 138 is removed from the cylinder during the recompression stroke and before the second combustion event. Such gas removed during the recompression stroke can be expected to have a higher hydrocarbon and soot content, which in the present embodiment is not exhausted from the engine and instead is recirculated into the intake manifold 130.

To further reduce emissions generated by the combustion process, the engine system 100 can include one or more after-treatment devices disposed along the exhaust line 142 that treat the exhaust gasses before they are discharged to the atmosphere. One example of an after-treatment device is a diesel particulate filter ("DPF") 190 that can trap or capture particulate matter in the exhaust gasses. Once the DPF has reached its capacity of captured particulate matter, it must be either cleaned or regenerated. Regeneration may be done either passively or actively. Passive regeneration utilizes heat inherently produced by the engine to burn or incinerate the captured particulate matter. Active regeneration generally requires higher temperature and employs an added heat source such as a burner to heat the DPF. Another after-treatment device that may be included with the engine system is a selective catalytic reduction ("SCR") system 192. In an SCR system 192, the exhaust gasses are combined with a reductant agent such as ammonia or urea and are directed through a catalyst that chemically converts or reduces the nitrogen oxides in the exhaust gasses to nitrogen and water. To provide the reductant agent, a separate storage tank 194 may be associated with the SCR system and in fluid communication with the SCR catalyst. A diesel oxidation catalyst 196 is a similar after-treatment device made from metals such as palladium and platinum that can convert hydrocarbons and carbon monoxide in the exhaust gasses to carbon dioxide. Other types of catalytic converters, three way converters, mufflers and the like can also be included as possible after-treatment devices.

In the embodiment shown in FIG. 2, the engine 100 includes a Lean NOx Trap (LNT) 197 instead of an SCR system 192 (FIG. 1) to reduce NOx emissions. The LNT 197 is disposed along an exhaust conduit 198 to receive exhaust gas from the turbine 156 either directly or after the exhaust gas has passed through other after-treatment components such as the DPF 190. A fuel injector 199 is connected to and associated with the exhaust conduit 198. The fuel injector 199 is configured to selectively inject fuel into the exhaust conduit 198, which mixes with the exhaust gas passing therethrough and reaches the LNT 197 causing it to regenerate. As is known, certain LNT devices are configured to store NOx thereon under lean engine operating conditions, and catalyze and release the NOx in different forms when the engine operates rich. To this end, fuel provided periodically through the injector 199 can create rich air/fuel conditions at the LNT 197, which causes the same to regenerate while the engine is otherwise still operating lean. The fuel injector 199 is optional and may be used depending on the engine control configuration.

To coordinate and control the various systems and components associated with the engine system 100, the system can include an electronic or computerized control unit, module or controller 200. The controller 200 is adapted to monitor various operating parameters and to responsively regulate various variables and functions affecting engine operation. The controller 200 can include a microprocessor, an application specific integrated circuit ("ASIC"), or other appropriate circuitry and can have memory or other data storage capabilities. The controller can include functions, steps, routines, data tables, data maps, charts and the like saved in and executable from read only memory to control the engine system. Although in FIGS. 1 and 2, the controller 200 is illustrated as a single, discrete unit, but in other embodiments, the controller and its functions may be distributed among a plurality of distinct and separate components. To receive operating parameters and send control commands or instructions, the controller can be operatively associated with and can communicate with various sensors and controls on the engine system 100. Communication between the controller and the sensors can be established by sending and receiving digital or analog signals across electronic communication lines or communication busses. The various communication and command channels are indicated in dashed lines for illustration purposes.

For example, to monitor the pressure and/or temperature in the combustion chambers 106, the controller 200 may communicate with chamber sensors 210 such as a transducer or the like, one of which may be associated with each combustion chamber 106 in the engine block 104. The chamber sensors 210 can monitor the combustion chamber conditions directly or indirectly. For example, by measuring the backpressure exerted against the intake or exhaust valves, or other components that directly or indirectly communicate with the combustion cylinder such as glow plugs, during combustion, the chamber sensors 210 and the controller 200 can indirectly measure the pressure in the combustion chamber 106. The controller can also communicate with an intake manifold sensor 212 disposed in the intake manifold 130 and that can sense or measure the conditions therein. To monitor the conditions such as pressure and/or temperature in the exhaust manifold 140, the controller 200 can similarly communicate with an exhaust manifold sensor 214 disposed in the exhaust manifold 140. From the temperature of the exhaust gasses in the exhaust manifold 140, the controller 200 may be able to infer the temperature at which combustion in the combustion chambers 106 is occurring.

To measure the flow rate, pressure and/or temperature of the air entering the engine, the controller 200 can communicate with an intake air sensor 220. The intake air sensor 220 may be associated with, as shown, the intake air filter 160 or another intake system component such as the intake manifold. The intake air sensor 220 may also determine or sense the barometric pressure or other environmental conditions in which the engine system is operating.

To further control the combustion process, the controller 200 can communicate with injector controls 230 that can control the fuel injectors 120 operatively associated with the combustion chambers 106. The injector controls 240 can selectively activate or deactivate the fuel injectors 120 to determine the timing of introduction and the quantity of fuel introduced by each fuel injector. To further control the timing of the combustion operation, the controller 200 can also communicate with a camshaft control 232 that is operatively associated with the camshaft 148 and/or camshaft actuator 149 to control the variable valve timing, when such a capability is used.

In embodiments having an intake throttle 155, the controller 200 can communicate with a throttle control associated with the throttle and that can control the amount of air drawn into the engine system 100. Alternatively, the amount of air used by the engine may be controlled by variably controlling the intake valves in accordance with a Miller cycle, which includes maintaining intake valves open for a period during the compression stroke and/or closing intake valves early during an intake stroke to thus reduce the amount of air compressed in the cylinder during operation. The controller 200 can also be operatively associated with either or both of the high-pressure EGR system 170 and the low-pressure EGR system 180. For example, the controller 200 is communicatively linked to a high-pressure EGR control 242 associated with the adjustable EGR valve 174 disposed in the high-pressure EGR line 182. Similarly, the controller 200 can also be communicatively linked to a low-pressure EGR control 244 associated with the adjustable EGR valve 184 in the low-pressure EGR line 182. The controller 200 can thereby adjust the amount of exhaust gasses and the ratio of intake air/exhaust gasses introduced to the combustion process.

Figure 11:
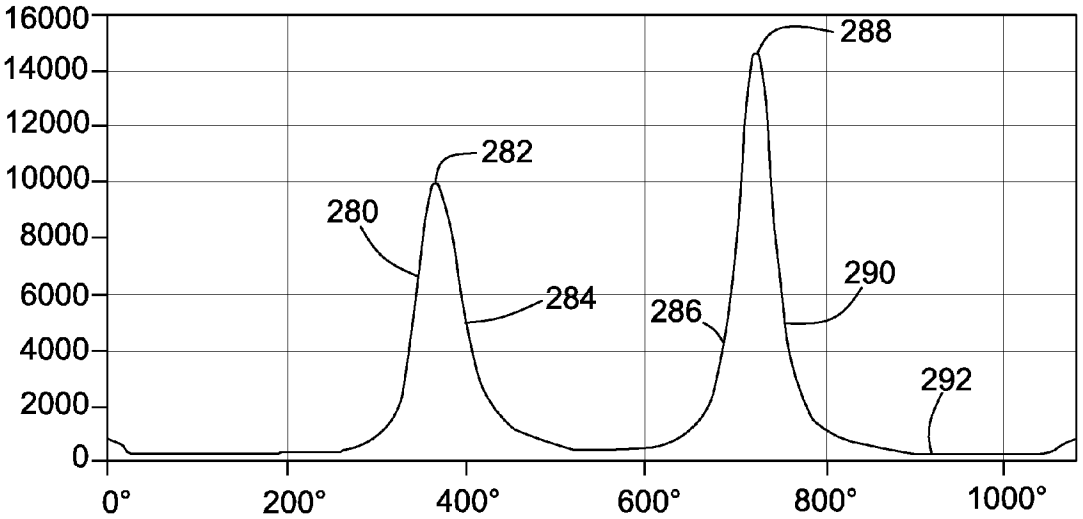
FIG. 11 is a chart illustrating a comparison of the internal cylinder pressure as measured against crankshaft angle for a six-stroke combustion cycle.
Figure 10:
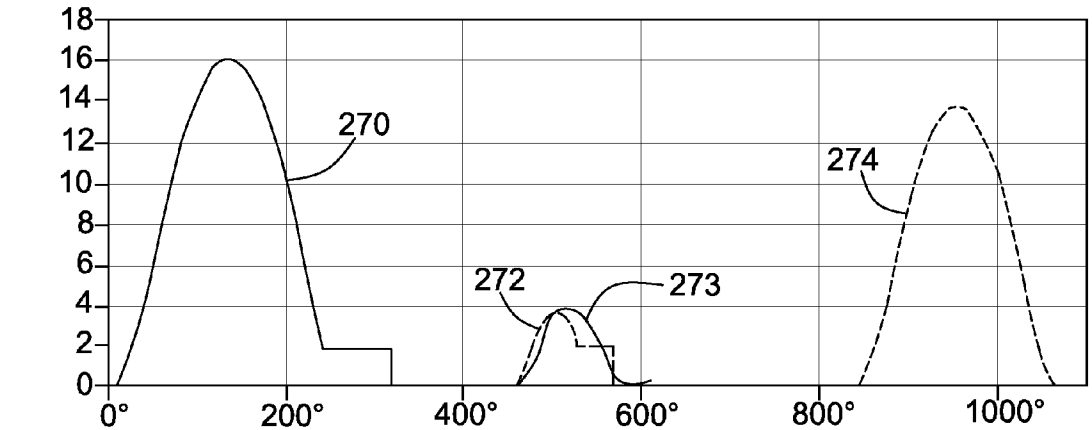
FIG. 10 is a chart representing the lift of the intake valve(s) and exhaust valve(s) as measured against crankshaft angle for a six-stroke combustion cycle.

The engine system 100 can operate in accordance with a six-stroke combustion cycle in which the reciprocal piston disposed in the combustion chamber makes six or more strokes between the top dead center ("TDC") position and bottom dead center ("BDC") position during each cycle. A representative series of six strokes and the accompanying operations of the engine components associated with the combustion chamber 106 are illustrated in FIGS. 3-9 and the valve lift and related cylinder pressure are charted with respect to crank angle in FIGS. 10 and 11. Additional strokes, for example, 8-stroke or 10-stroke operation and the like, which would include one or more successive recompressions, are not discussed in detail herein as they would be similar to the recompression and re-combustion that is discussed, but are contemplated to be within the scope of the disclosure.

The actual strokes are performed by a reciprocal piston 250 that is slidably disposed in an elongated cylinder 252 bored into the engine block. One end of the cylinder 250 is closed off by a flame deck surface 254 so that the combustion chamber 106 defines an enclosed space between the piston 250, the flame deck surface and the inner wall of the cylinder. The reciprocal piston 250 moves between the TDC position where the piston is closest to the flame deck surface 254 and the BDC position where the piston is furthest from the flame deck surface. The motion of the piston 250 with respect to the flame deck surface 254 thereby defines a variable volume 258 that expands and contracts.

Figures 3, 4, 5, 6, 7, 8, 9:
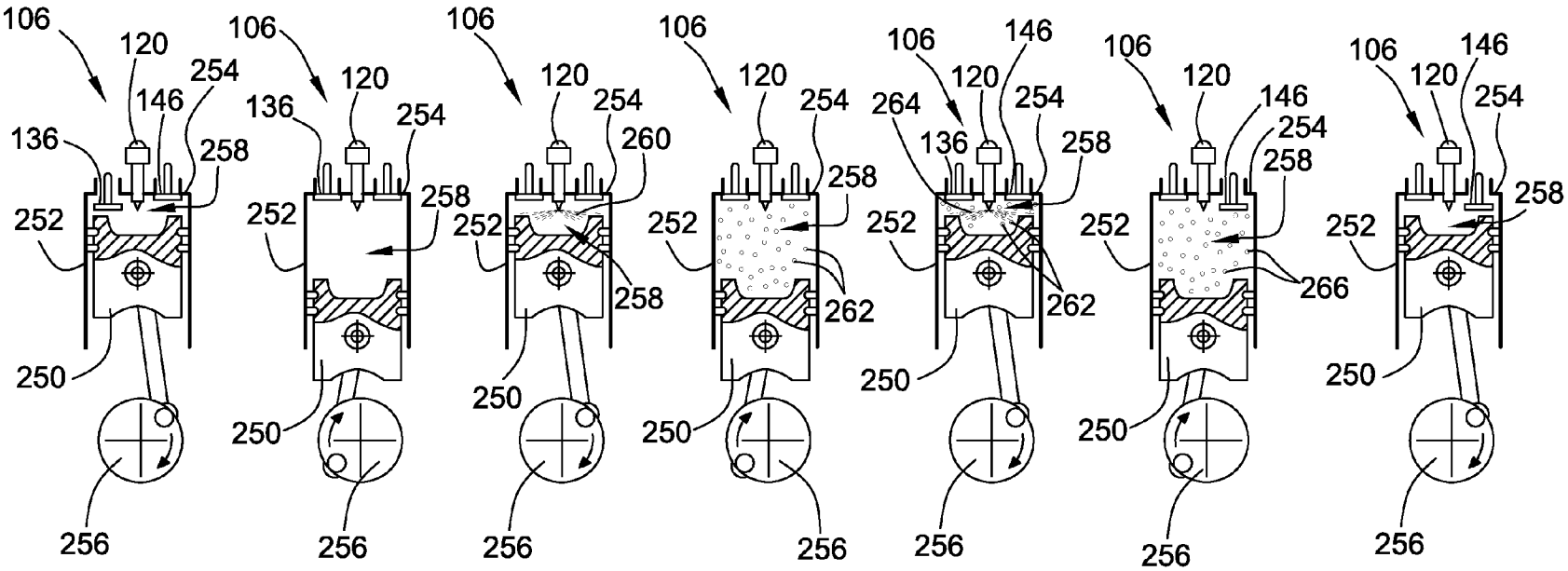
FIGS. 3-9 are cross-sectional views representing an engine cylinder and a piston movably disposed therein at various points during a six-stroke combustion cycle.

Referring to FIG. 3, the six-stroke cycle starts with an intake stroke during which the piston 250 moves from the TDC position to the BDC position causing the variable volume 258 to expand. During this stroke, the intake valve 136 is opened so that air or an air/fuel mixture may be drawn into the combustion chamber 106, as represented by the positive bell-shaped intake curve 270 indicating intake valve lift in FIG. 10. The duration of the intake valve opening may optionally be adjusted to control the amount of air provided to the cylinder, as previously discussed. Referring to FIG. 4, once the piston 250 reaches the BDC position, the intake valve 136 closes and the piston can perform a first compression stroke moving back toward the TCD position and compressing the variable volume 258 that has been filled with air during the intake stroke. As indicated by the upward slope of the first compression curve 280 in FIG. 11, this motion increases pressure and temperature in the combustion chamber. In diesel engines, the compression ratio can be on the order of 15:1, although other compression ratios are common.

As illustrated in FIG. 5, in those embodiments in which air or an air/exhaust gas mixture is initially drawn into the combustion chamber 106, the fuel injector 120 can introduce a first fuel charge 260 into the variable volume 258 to create an air/fuel mixture as the piston 250 approaches the TDC position. The quantity of the first fuel charge 260 can be such that the resulting air/fuel mixture is lean, meaning there is an excess amount of oxygen to the quantity of fuel intended to be combusted. At an instance when the piston 250 is at or close to the TDC position and the pressure and temperature are at or near a first maximum pressure, as indicated by point 282 in FIG. 11, the air/fuel mixture may ignite. In embodiments where the fuel is less reactive, such as in gasoline burning engines, ignition may be induced by a sparkplug, by ignition of a pilot fuel or the like.

During a first power stroke, the combusting air/fuel mixture expands forcing the piston 250 back to the BDC position as indicated in FIGS. 5 to 6. The piston 250 can be linked or connected to a crankshaft 256 so that its linear motion is converted to rotational motion that can be used to power an application or machine. The expansion of the variable volume 258 during the first power stroke also reduces the pressure in the combustion chamber 106 as indicated by the downward sloping first expansion curve 284 in FIG. 11. At this stage, the variable volume contains the resulting combustion products 262 that may include unburned fuel, soot, ash and excess oxygen from the intake air, which remains unburned, especially if the first air/fuel mixture in the cylinder was selected to be leaner than stoichiometric.

Referring to FIG. 7, in the six-stroke cycle, the piston 250 can perform another compression stroke in which it compresses the combustion products 262 in the variable volume 258 by moving back to the TDC position. During the second compression stroke, both the intake valve 136 and exhaust valve 146 are typically closed so that pressure increases in the variable volume as indicated by the second compression curve 286 in FIG. 11. In the embodiment of FIG. 1, the exhaust valve 146 may be briefly opened to discharge some of the contents in a process referred to as blowdown, as indicated by the small blowdown curve 272 in FIG. 10, into the exhaust manifold 140 of the engine. Similarly, the intake valve 136 may open, in addition to or instead of the exhaust valve 146 opening, as indicated by the small intake blib curve 273, to provide a type of internal exhaust gas recirculation to the engine.

In other words, as the piston is recompressing the byproducts of the first power stroke that are present in the cylinder, the pressure of those byproducts will increase beyond the fluid pressure in the intake and exhaust manifolds of the engine. Under such conditions, opening the intake valve 136 will cause blowdown exhaust gas to exit the cylinder and pass directly into the intake manifold of the engine. Such internal EGR, however, may not suffice to remove an adequate amount of blowdown exhaust gas from the cylinder, so the opening of the exhaust gas valve 146 may also be required.

In the engine embodiment shown in FIG. 1, release of blowdown exhaust gas into the exhaust manifold 140 will increase the "feed-gas" or "engine-out" emissions of the engine, which are terms commonly used to refer to engine emissions before those emissions are treated in an after-treatment system. Increasing such emissions is not always desired, nor is it always possible to mitigate the increased emissions such that the engine still conforms to emissions regulations.

The engine embodiment shown in FIG. 2 is configured to address these concerns by permitting the segregation of blowdown exhaust gases from the feed-gas of the engine. As previously discussed, the engine in this embodiment includes the recirculation passage 138, which operates to segregate blowdown exhaust gas from the main exhaust stream of the engine as previously described. Here, the blowdown exhaust gas removed from the cylinders during the recompression stroke, which is accomplished by opening the recirculation valves 137, which may contain unburned fuel, soot, and other products, is circulated into the intake system of the engine, where it mixes with incoming air and re-enters the engine cylinders during subsequent intake strokes.

Regardless of the cylinder valve arrangement used, the introduction of blowdown exhaust gas into the intake system of the engine, either by opening the intake valve 136 in the embodiment shown in FIG. 1, or the recirculation valve 137 in the embodiment shown in FIG. 2, can advantageously reduce engine emissions by providing an EGR effect to the combustion process. Moreover, the segregation of the blowdown exhaust gas from the main exhaust stream of the engine can avoid increasing engine emissions. To obtain the desired amount of blowdown exhaust gas and thus produce the desired EGR effect, the controller 200, camshaft 148, and/or valve actuators can assist in coordinating activation of the intake and exhaust valves 136, 146 in the embodiment of FIG. 1 or activation of the recirculation valve 137 in the embodiment of FIG. 2. In either case, the timing and duration of valve activation events may be changed based on the operating parameters of the engine such as engine load, engine speed, intake and/or ambient air temperature, cylinder pressure, exhaust gas temperature, blowdown exhaust gas temperature, and other parameters.

Figure 12:
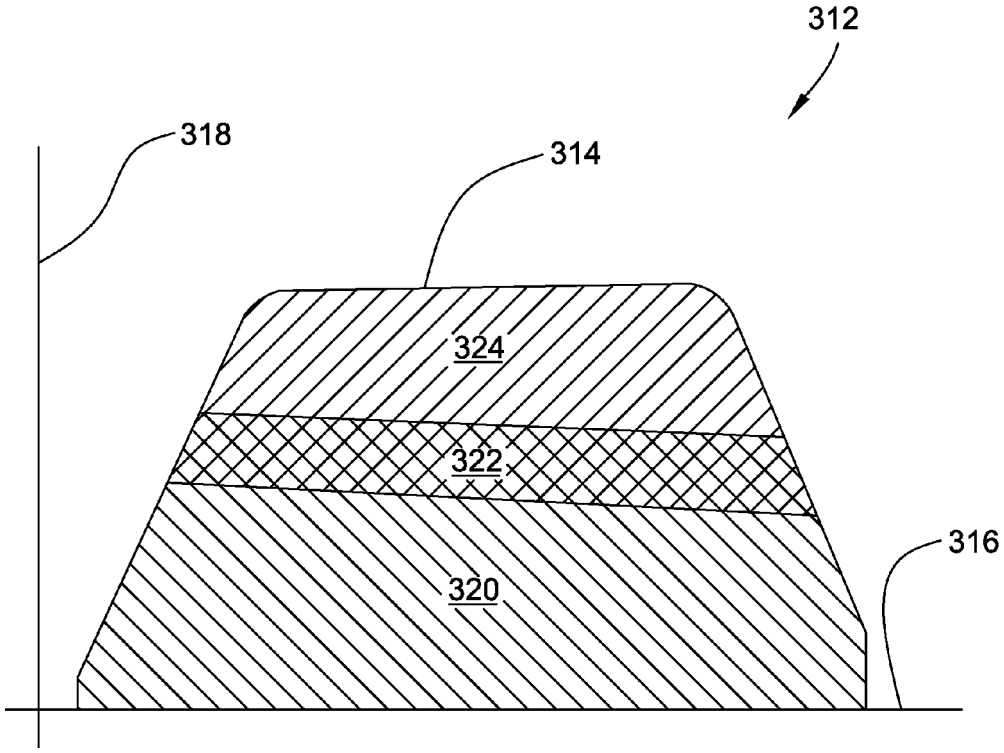
FIG. 12 is a chart representing an engine map in accordance with the disclosure.

Returning now to FIG. 7, when the piston 250 reaches the TDC position shown in FIG. 7, by which time the intake and exhaust valves 136 and 146 and/or the recirculation valve 137 have closed, the fuel injector 120 can introduce a second fuel charge 264 into the combustion chamber 106 that can intermix with the combustion products 262 from the previous combustion event that remain in the cylinder. Referring to FIG. 12, at this instance, the pressure in the compressed variable volume 258 will be at a second maximum pressure 288. The second maximum pressure 288 may be greater than the first maximum pressure 282 or may be otherwise controlled to be about the same or lower than the first pressure. For example, to reduce the second maximum pressure 288, the engine may be controlled to remove more blowdown exhaust gas and/or reduce the amount of fuel provided to the cylinder in the second fuel charge 264.

The quantity of the second fuel charge 264 provided to the cylinder, in conjunction with oxygen that may remain within the cylinder, can be selected such that stoichiometric or near stoichiometric conditions for combustion are provided within the combustion chamber 106. At stoichiometric conditions, the ratio of fuel to air is such that substantially the entire second fuel charge will react with all the remaining oxygen in the combustion products 262. When the piston 250 is at or near the TDC position and the combustion chamber 106 reaches the second maximum pressure 288, the second fuel charge 264 and the previous combustion products 262 may spontaneously ignite. Referring to FIGS. 7 to 8, the second ignition and resulting second combustion expands the contents of the variable volume 258 forcing the piston toward the BDC position resulting in a second power stroke driving the crankshaft 256. The second power stroke also reduces the pressure in the cylinder 252 as indicated by the downward sloping second expansion curve 290 in FIG. 11.

The second combustion event can further incinerate the unburned combustion products from the initial combustion event such as unburned fuel and soot. The quantity or amount of hydrocarbons in the resulting second combustion products 266 remaining in the cylinder 252 may also be reduced. Referring to FIG. 9, an exhaust stroke can be performed during which the momentum of the crankshaft 256 moves the piston 250 back to the TDC position with the exhaust valve 146 opened to discharge the second combustion products to the exhaust system. Alternatively, additional recompression and re-combustion strokes can be performed. With the exhaust valve opened as indicated by the bell-shaped exhaust curve 274 in FIG. 10, the pressure in the cylinder can return to its initial pressure as indicated by the low, flat exhaust curve 292 in FIG. 11.

It should be appreciated that both a traditional EGR system, such as the low- and/or high-pressure EGR systems 180 and 170, as well as a system for re-circulating blowdown exhaust gas, such as the recirculation passage 138 that cooperates with the recirculation valves 137, may advantageously be used alongside one another. For example, the traditional EGR system may operate at relatively lower engine speeds and loads, such as idle, where the combustion cylinder pressures and engine emissions may not require removal and recirculation of exhaust blowdown gases. Similarly, at high engine speeds and, especially, at high engine loads, the EGR system may be operating to recirculate little or no exhaust gas, such that the maximum amount of oxygen can be provided to the cylinders for combustion, while the blowdown recirculation system may be operating at or close to a maximum capacity to ensure that peak cylinder pressures remain below the operating thresholds of the engine.

In this way, an engine controller that monitors and controls operation of various engine components and systems such as intake, exhaust and recirculation valve timing, EGR valve operation, fuel injector activation for injection duration and initiation, may be used to control and optimize engine operation and emissions. The controller may monitor various signals indicative of operation of the engine combustion system, for example, exhaust temperature, blowdown gas temperature, cylinder pressure, engine airflow, EGR gas flow, EGR valve position, exhaust pressure, intake pressure, intake air temperature, altitude and the like either directly by use of sensors, as previously discussed, or indirectly by calculating or otherwise estimating these parameters.

With such information, and relative to the present disclosure, the controller may dynamically balance, in real time, the control of EGR gas and blowdown gas that is recirculated in the engine based on the operating point of the engine. The engine operating point may be indicated by the then-present engine speed and load at which the engine is operating. The magnitude of exhaust gas recirculation through the EGR system and the blowdown gas recirculation system for each engine operating point may be determined based on predetermined control parameters, which can be tabulated against engine speed and load, and be corrected based on the engine operating parameters measured or estimated.

For example, for a given engine speed and load, the controller may provide an EGR control signal to an EGR valve that causes a valve opening that corresponds to a desired EGR rate. In the same operating condition, the controller may also provide a valve timing signal to a device that determines the timing and/or duration of the valve opening of at least the recirculation valve that corresponds to a desired blowdown exhaust gas recirculation rate, as discussed above relative to the engine embodiment shown in FIG. 2. The EGR control signal and/or valve timing signal provided by the controlled may be adjusted from their predetermined values if warranted by the engine operating parameters. For example, if a high cylinder pressure is detected by the controller during the second combustion stroke, recirculation of exhaust blowdown gas may be increased, to help reduce cylinder pressure in the second combustion stroke, while EGR gas recirculation may be decreased, so that sufficient oxygen is still provided to the engine cylinders for combustion of the fuel required to produce a desired engine power output and/or a desired air/fuel ratio within the cylinder for the first and/or second combustion event(s).

A representative engine map showing areas of engine operation where EGR, exhaust blowdown recirculation or both may be desired is shown in FIG. 12. The engine map 312 includes an engine torque or lug curve 314 plotted against engine speed 316 in the horizontal axis and engine torque output 318 in the vertical axis. A space under the lug curve 314 is segregated in three areas: a first area 320, which represents low engine loads, a second area 322, which represents mid-load conditions, and a third area 324, which represents high engine load conditions.

In reference to the engine map 312, each engine operating condition may be represented on the map by a point, which corresponds to the then-present engine speed and load. In the map 312, the collection of points belonging to the first area 320 represent points during which the engine uses the traditional EGR system, at different degrees that are tailored to the particular engine system, to control emissions. The collection of points belonging to the third area 324 represent points during which the engine primarily uses blowdown exhaust gas recirculation to control emissions. The collection of points belonging to the second area 322 represent transitional points during which the engine may use both traditional EGR and blowdown exhaust gas recirculation to control emissions. Thus, depending on whether the engine operating point on the map falls in the first, second or third areas 320, 322 or 324, the controller may provide the appropriate commands to the various engine components and systems affecting cylinder operation.

In addition to controlling the EGR and blowdown exhaust recirculation functions of the engine referring to FIG. 2, the controller may estimate the extent of nitrogen oxide absorption in the LNT 197 to decide when, as applicable, regeneration may be required. At times when regeneration is required, the controller may send an activation signal to the fuel injector 199 associated with the LNT 197 such that regeneration may be carried out. Alternatively, in the event the fuel injector 199 is not installed on the engine, the controller may adjust the airflow into the cylinder by increasing the rate of recirculation of EGR gas and/or blowdown gas, as well as increasing the fuel injection amount, such that the ordinarily lean air/fuel mixture present in the cylinder becomes richer than stoichiometric. Such a shift in the air/fuel mixture can result in the presence of unburned fuel in the engine exhaust gas stream, which will flow to the LNT 197 and help regenerate the same.

INDUSTRIAL APPLICABILITY

Figure 13:
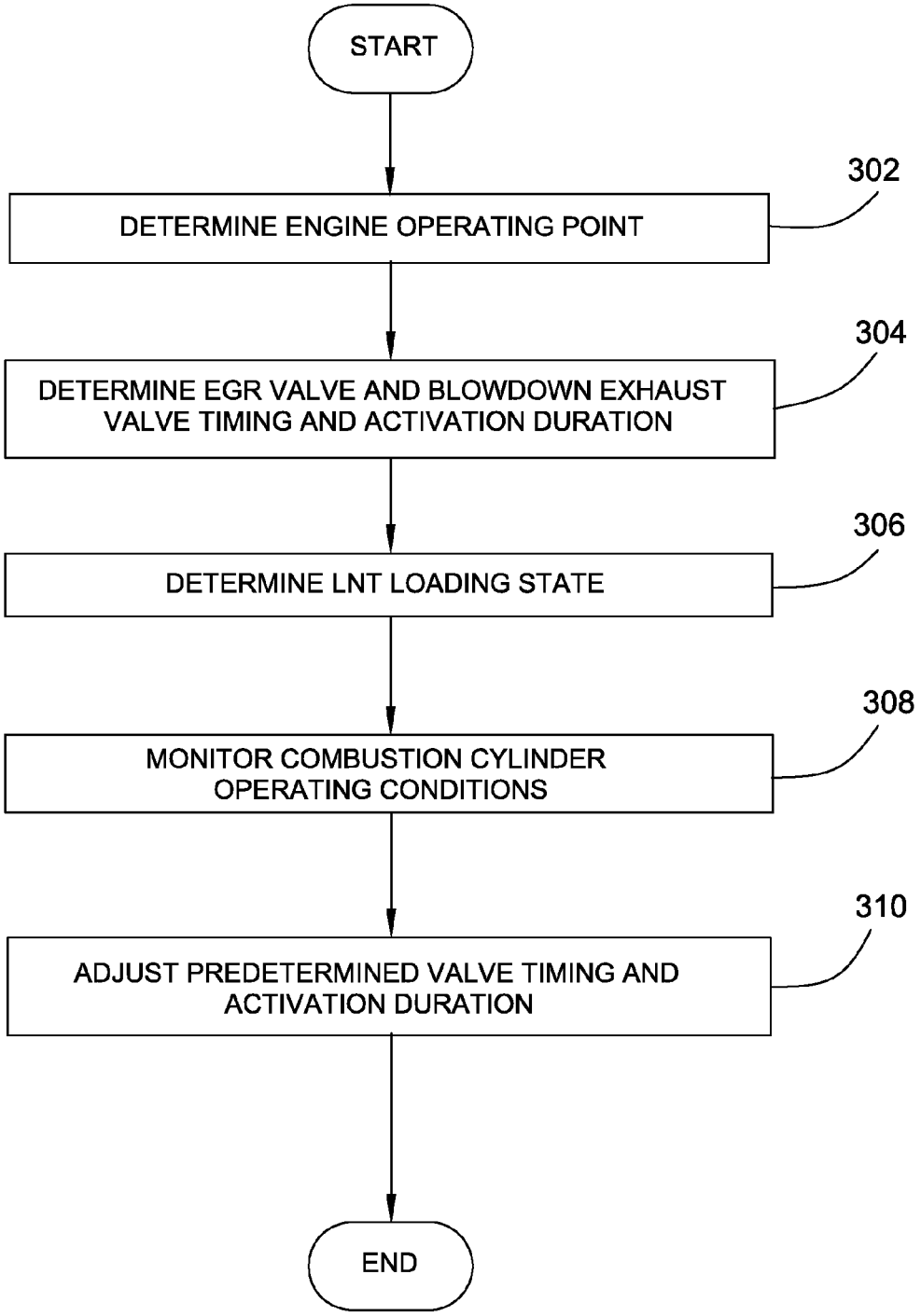
FIG. 13 is a flowchart for a method of operating a six-stroke combustion cycle engine in accordance with the disclosure.

The present disclosure is applicable to internal combustion engines performing a six-stroke combustion cycle. A flowchart for a method of controlling engine airflow and emissions is provided in FIG. 13. In reference to the flowchart, the engine operating point is determined at 302. Determination of the engine operating point may include a reading in an electronic controller of parameters indicative of the then-present engine speed and load. The engine speed may be determined based on a sensor reading that indicates the rate of rotation of an engine crankshaft, camshaft, or other rotating engine component. Engine load may be determined directly, for example, by a strain sensor associated with an engine output shaft, or may alternatively be determined based on a fueling command provided to the fuel injectors of the engine, where the amount of engine fuel is indicative of engine torque or power output.

On the basis of engine operating point as a primary control parameter, the timing and duration of activation of the EGR valve and blowdown exhaust valve are determined in the controller at 304. As previously discussed, in one embodiment, the controller may contain lookup tables or other functions operating to determine or interpolate a desired valve activation signal based on the then-present engine operating point. The desired EGR valve control signal thus determined may be provided as a setpoint to an EGR valve controller. Alternatively, the EGR valve control signal may be provided in the form of a desired EGR gas flow rate, which is then provided to an EGR valve system control module that monitors various engine parameters, for example, comparing signals from an engine intake mass air flow sensor with signals from a sensor measuring EGR gas flow rate or, alternatively, with a theoretical calculation of the volumetric efficiency of the engine, to calculate the effective rate of EGR gas provided to the engine. Similarly, a blowdown exhaust valve control signal may be provided to an actuator operating to push the recirculation valve open (see, for example, valve 137 in FIG. 2), or may alternatively provide a command signal to a device operating to vary engine valve timing.

The controller may then determine the loading state of a LNT catalyst at 306, to determine whether regeneration is required. Various engine operating parameters indicative of the operating conditions of the combustion cylinders are monitored at 308. Operating conditions of the combustion cylinders may include signals indicative of exhaust temperature, blowdown gas temperature, cylinder pressure, engine airflow, EGR gas flow, EGR valve position, exhaust pressure, intake pressure, intake air temperature, altitude and the like, but fewer or more of the signals listed here can be used.

Based on the determination at 306 of the LNT loading state, and further based on the various operating conditions monitored at 308, the controller may adjust at the predetermined valve timing and activation duration at 310. As previously discussed, adjustments may be made to address operating thresholds of cylinder operation as well as, in some instances, to facilitate LNT regeneration. More particularly, the monitoring of engine parameters may indicate that, possibly due to environmental conditions, the operation of the combustion cylinders is approaching operational limits. For example, higher than expected cylinder pressures, which can result from clogging in the blowdown recirculation system, may require an increase in the opening duration of the exhaust blowdown recirculation valves. Also, while some embodiments may include a fuel injector disposed in the exhaust system and operating to provide the hydrocarbons required to regenerate the LNT (see, for example, injector 199 in FIG. 2), in embodiments where no such injector is provided, the air/fuel ratio may be made rich so that unburned hydrocarbons are provided in the engine exhaust stream. To accomplish this in these embodiments, EGR flow may be increased to displace oxygen provided to the combustion cylinder and/or fuel injection duration may be increased, to provide a rich air/fuel mixture.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. An internal combustion engine having a combustion cylinder, which operates on a combustion cycle that includes an intake stroke, during which air is admitted into the combustion cylinder, a compression stroke, during which the air in the combustion cylinder is compressed and fuel is added, a first combustion stroke, a recompression stroke, during which products from the first combustion stroke are compressed in the combustion cylinder and additional fuel is added, a second combustion stroke, and an exhaust stroke, the engine comprising:

an intake system including an intake collector in fluid communication with the combustion cylinder;

an exhaust system including an exhaust collector in fluid communication with the combustion cylinder;

a recirculation system including a recirculation passage connected to the combustion cylinder via a recirculation runner;

at least one intake valve disposed to selectively fluidly connect the combustion cylinder with the intake system;

at least one exhaust valve disposed to selectively fluidly connect the combustion cylinder with the exhaust system;

a recirculation valve disposed to selectively fluidly connect the combustion system with the recirculation runner;

a valve activation system configured to activate the at least one intake valve, the recirculation valve, and the at least one exhaust valve; and a controller associated with the internal combustion engine is configured to provide command signals to the valve activation system, such that:

the at least one intake valve is opened during the recompression stroke to allow a portion of the products from the first combustion stroke to exit the combustion cylinder and enter into the intake collector, and the recirculation valve is opened during the recompression stroke to allow an additional portion of the products to enter into the recirculation passage.

2. The internal combustion engine of claim 1, further comprising an exhaust gas recirculation (EGR) system that includes an EGR valve, the EGR valve being fluidly interconnected between the exhaust system and the intake system such that, when the EGR valve is open, a portion of products from the second combustion stroke that are provided to the exhaust system is provided, through the EGR valve, to the intake system of the internal combustion engine.

3. The internal combustion engine of claim 2, wherein the controller is further configured to control an opening of the EGR valve.

4. The internal combustion engine of claim 3, wherein the controller is arranged to provide the command signals to the valve activation system and to the EGR valve using an engine operating point as a primary control parameter.

5. The internal combustion engine of claim 1, wherein the controller is arranged to provide the command signals to the valve activation system using an engine operating point as a primary control parameter.

6. The internal combustion engine of claim 1, further comprising a lean NOx trap (LNT) associated with the exhaust system, wherein the controller is further configured to monitor a loading state of the LNT and to provide the control signals based at least in part on the loading state of the LNT.

7. The internal combustion engine of claim 6, further comprising a fuel injector associated with the exhaust system and configured to selectively inject fuel within the exhaust system, wherein said fuel is adapted to pass through and help regenerate the LNT, and wherein the controller is further configured to command activation of the fuel injector based at least in part on the loading state of the LNT.

8. The internal combustion engine of claim 1, wherein the controller is further configured to provide the command signals to the valve activation system such that the at least one exhaust valve is opened during the recompression stroke to allow an additional portion of the products from the first combustion stroke the exit the combustion cylinder and enter into the exhaust collector.

9. An internal combustion engine having a combustion cylinder, which operates on a combustion cycle that includes an intake stroke, during which air is admitted into the combustion cylinder, a compression stroke, during which the air in the combustion cylinder is compressed and fuel is added, a first combustion stroke, a recompression stroke, during which products from the first combustion stroke are compressed in the combustion cylinder and additional fuel is added, a second combustion stroke, and an exhaust stroke, the engine comprising:

an intake system including an intake collector in fluid communication with the combustion cylinder;

an exhaust system configured to receive exhaust gas from the combustion cylinder, the exhaust system including an exhaust collector in fluid communication with the combustion cylinder;

a blowdown gas passage in fluid communication with the combustion cylinder and the intake system, the blowdown gas passage being fluidly isolated from the exhaust system;

at least one intake valve disposed to selectively fluidly connect the combustion cylinder with the intake system;

at least one exhaust valve disposed to selectively fluidly connect the combustion cylinder with the exhaust system; and at least one recirculation valve disposed to selectively fluidly connect the combustion cylinder with the blowdown gas passage;

a valve activation system configured to activate the at least one intake valve, the at least one recirculation valve, and the at least one exhaust valve; and a controller associated with the internal combustion engine, the controller being configured to provide command signals to the valve activation system, such that:

the at least one recirculation valve is opened during the recompression stroke to allow a portion of the products from the first combustion stroke to exit the combustion cylinder and to enter into the intake collector through the blowdown gas passage.

10. The internal combustion engine of claim 9, further comprising an exhaust gas recirculation (EGR) system that includes an EGR valve, the EGR valve being fluidly interconnected between the exhaust system and the intake system such that, when the EGR valve is open, products from the second combustion that are provided to the exhaust system are provided, through the EGR valve, to the intake system of the internal combustion engine.

11. The internal combustion engine of claim 10, wherein the controller is further configured to control an opening of the EGR valve.

12. The internal combustion engine of claim 11, wherein the controller is arranged to provide the command signals to the valve activation system and to the EGR valve using an engine operating point as a primary control parameter.

13. The internal combustion engine of claim 9, wherein the controller is arranged to provide the command signals to the valve activation system using an engine operating point as a primary control parameter, the engine operating point being determined based on information indicative of engine speed and engine load.

14. The internal combustion engine of claim 9, further comprising a lean NOx trap (LNT) associated with the exhaust system, wherein the controller is further configured to monitor a loading state of the LNT and to provide the control signals based at least in part on the loading state of the LNT.

15. The internal combustion engine of claim 14, further comprising a fuel injector associated with the exhaust system and configured to selectively inject fuel within the exhaust system, wherein said fuel is adapted to pass through and help regenerate the LNT, and wherein the controller is further configured to command activation of the fuel injector based at least in part on the loading state of the LNT.

16. The internal combustion engine of claim 9, wherein the controller is further configured to provide the command signals to the valve activation system such that the at least one exhaust valve is opened during the recompression stroke to allow an additional portion of the products form the first combustion stroke the exit the combustion cylinder and enter into the exhaust collector.

17. A method for operating a valve system on an internal combustion engine having a combustion cylinder, the combustion cylinder operating on a combustion cycle that includes an intake stroke, during which air is admitted into the combustion cylinder, a compression stroke, during which the air in the combustion cylinder is compressed and fuel is added, a first combustion stroke, a recompression stroke, during which products from the first combustion stroke are compressed in the combustion cylinder and additional fuel is added, a second combustion stroke, and an exhaust stroke, the method comprising:

fluidly connecting the combustion cylinder with an intake system to provide air or an air mixture to fill the combustion cylinder during the intake stroke;

fluidly connecting the combustion cylinder with a recirculation passage to inject products from the first combustion into the intake system via the recirculation passage during the recompression stroke;

mixing the products from the first combustion stroke with air or the air mixture in the intake system; and fluidly connecting the combustion cylinder with an exhaust system during the exhaust stroke to evacuate products of the second combustion stroke from the combustion cylinder.

18. The method of claim 17, further comprising recirculating a portion of the products of the second combustion stroke from the exhaust system into the intake system through an exhaust gas recirculation (EGR) system that includes an EGR valve, the EGR valve being fluidly interconnected between the exhaust system and the intake system such that, when the EGR valve is open, the portion of the products from the second combustion stroke that are provided to the exhaust system is provided, through the EGR valve, to the intake system of the internal combustion engine.

19. The method of claim 18 further comprising controlling the EGR valve simultaneously with fluidly connecting the combustion cylinder with the intake system to inject products from the first combustion stroke into the intake system by using an engine operating point as a primary control parameter.

20. The method of claim 17, wherein fluidly connecting the combustion cylinder with the intake system to inject products from the first combustion stroke into the intake system is selectively accomplished by using an engine operating point as a primary control parameter.

21. The method of claim 17, further comprising capturing emissions passing thorough the exhaust system by use of a lean NOx trap (LNT) associated with the exhaust system, monitoring a loading state of the LNT, and fluidly connecting the combustion cylinder with the intake system to inject products from the first combustion stroke into the intake system based at least in part on the loading state of the LNT.

22. The method of claim 21, further comprising selectively injecting fuel within the exhaust system, wherein said fuel is adapted to pass through and help regenerate the LNT, and command said injection of fuel within the exhaust system based at least in part on the loading state of the LNT.

23. The method of claim 17, further comprising fluidly connecting the combustion cylinder with the exhaust system to inject an additional portion of the products from the first combustion stroke into the exhaust system during the recompression stroke.

* * * * *